US007173639B2

(12) United States Patent
Huang

(10) Patent No.: US 7,173,639 B2
(45) Date of Patent: Feb. 6, 2007

(54) SPATIAL LIGHT MODULATOR DATA REFRESH WITHOUT TEARING ARTIFACTS

(75) Inventor: Samson Huang, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 631 days.

(21) Appl. No.: 10/120,812

(22) Filed: Apr. 10, 2002

(65) Prior Publication Data

US 2003/0193514 A1 Oct. 16, 2003

(51) Int. Cl.
*G09G 5/10* (2006.01)

(52) U.S. Cl. ..... 345/691; 348/759; 359/242

(58) Field of Classification Search ..... 345/691, 345/85, 205, 84, 86, 87, 694, 693, 94, 208, 345/589, 603, 530, 539; 348/490, 493, 759; 359/299, 242; 318/811
See application file for complete search history.

(56) References Cited

U.S. PATENT DOCUMENTS 5,162,786 A * 11/1992 Fukuda ..... 345/100
5,548,301 A * 8/1996 Kornher et al. ..... 345/85
5,719,598 A * 2/1998 Latham ..... 345/419
5,751,379 A * 5/1998 Markandey et al. ..... 348/759
5,969,710 A * 10/1999 Doherty et al. ..... 345/693
6,091,463 A * 7/2000 Robinson et al. ..... 349/25
6,232,963 B1 * 5/2001 Tew et al. ..... 345/204
6,300,924 B1 * 10/2001 Markandey et al. ..... 345/84
6,377,234 B1 * 4/2002 Nogawa ..... 345/89
6,545,672 B1 * 4/2003 Goyins ..... 345/204
6,753,872 B2 * 6/2004 Moriwaki et al. ..... 345/537

FOREIGN PATENT DOCUMENTS

JP 09-134148 * 5/1997

* cited by examiner

*Primary Examiner*—Richard Hjerpe
*Assistant Examiner*—Abbas I. Abdulselam
(74) *Attorney, Agent, or Firm*—Paul E. Steiner

(57) ABSTRACT

A pulse width modulation driven display such as a spatial light modulator, which updates pixel data between PWM periods of consecutive frames, to avoid tearing artifacts in the perceived display image.

29 Claims, 4 Drawing Sheets

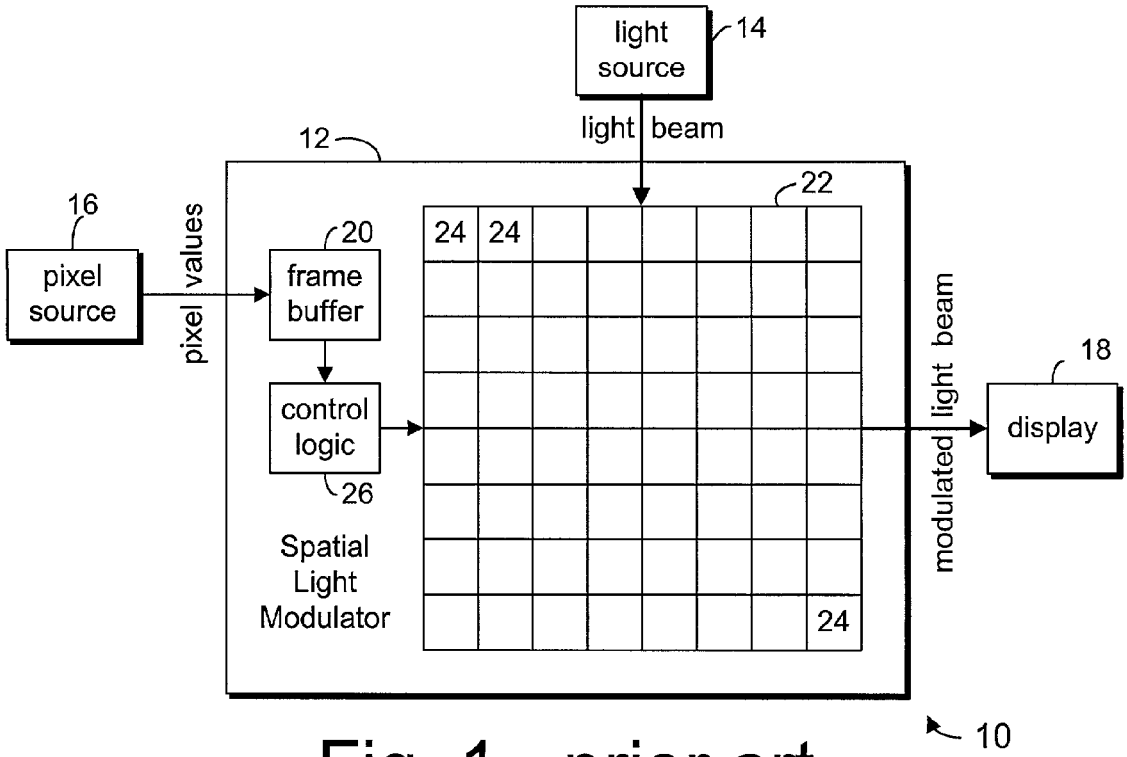
Fig. 1 - prior art
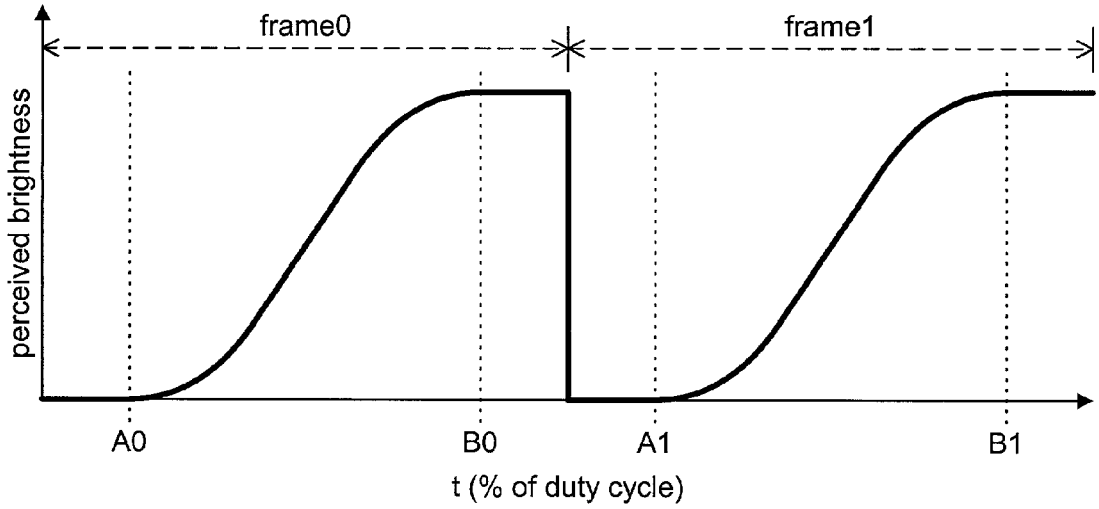
Fig. 2

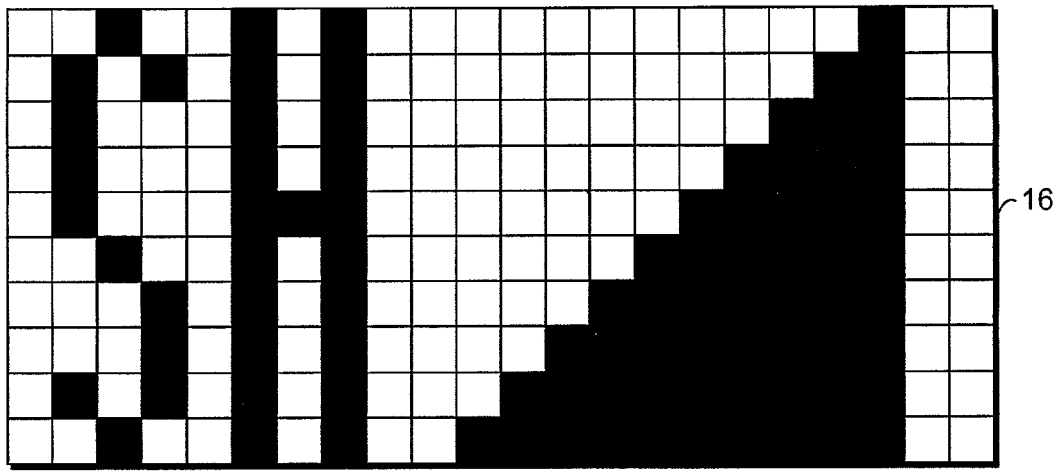
Fig. 3A - prior art
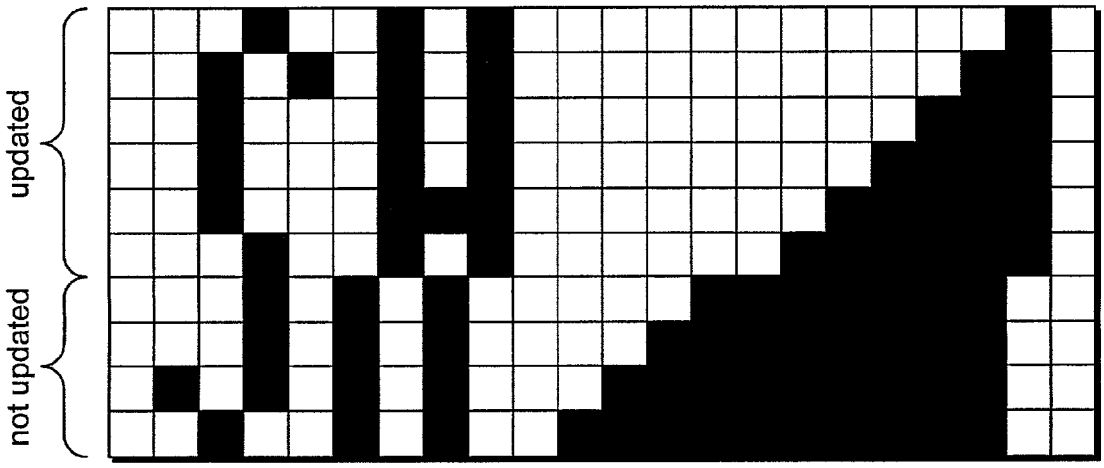
Fig. 3B - prior art
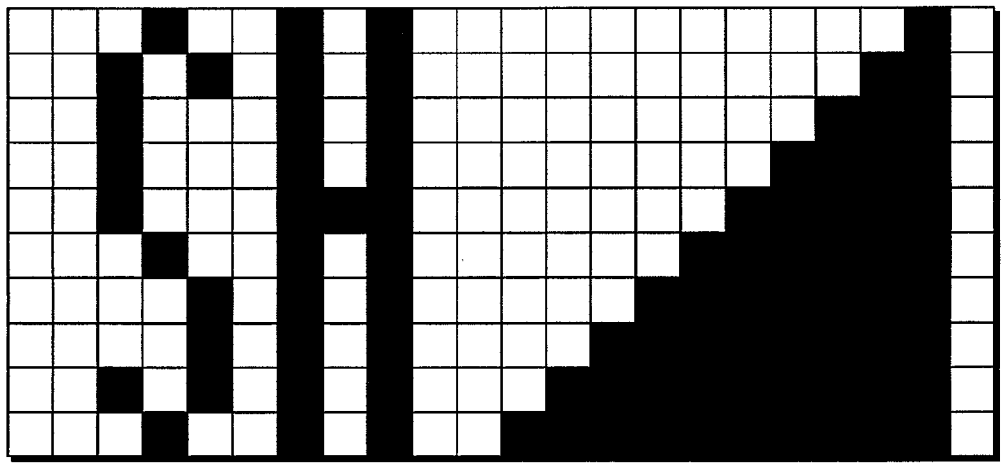
Fig. 3C - prior art

SPATIAL LIGHT MODULATOR DATA REFRESH WITHOUT TEARING ARTIFACTS

BACKGROUND OF THE INVENTION

1. Technical Field of the Invention

The present invention relates generally to spatial light modulators, and more specifically to a spatial light modulator having a mechanism for performing data refresh without causing tearing artifacts in the display.

2. Background Art

FIG. 1 illustrates a conventional display system 10 having a spatial light modulator (SLM) 12 which modulates a light beam from a light source 14 such as an ultra-high-pressure (UHP) lamp according to pixel value data from a pixel source 16 such as a graphics engine, for display on a display device 18 such as a rear projection television screen. The SLM has a frame buffer memory 20 which stores the pixel values and provides them to a pixel array 22 of independently-controllable pixel cells 24 under control of control logic 26. The pixel cells typically operate like liquid crystal display cells, in that they can be controlled to transmit or not transmit light, depending on a control voltage or current applied to them. In some SLMs, a pulse width modulation (PWM) scheme is used, giving a pixel any of a number of digital values. The longer the PWM signal is on, the longer the pixel cell is transmissive, making the pixel brighter; the longer the PWM signal is off, the longer the pixel cell is opaque, making the pixel darker.

FIG. 2 illustrates a typical PWM transfer curve of a pixel cell, and represents perceived brightness (vertical axis) over time (horizontal axis). Time can be expressed in terms of percentages of the duty cycle of the PWM signal during respective frames of display. Two frames (frame0 and frame1) are illustrated. For a first period of time, from the start until "A0", having the signal on does not give any perceivable brightness to the pixel. Then, from "A0" to "B0", the longer the signal is held on, the brighter the pixel is perceived to be. Then, after "B0" until the end of the frame, continuing to hold the PWM signal on does not yield any perceived additional brightness beyond that achieved at "B0". Then, the same function is repeated for the next frame.

Commonly, the perceived brightness is not a purely linear function between "A0" and "B0", and techniques such as lookup tables are used to compensate for the particular transfer curve of the pixel technology at hand. The desired brightness (typically expressed as a digital value from 0 to 255) is used as an index into the lookup table, which outputs a value indicating how long the PWM signal should be held on to achieve the specified brightness.

FIGS. 3A–C illustrate tearing in the display. Each image may be interpreted to represent either the display, the display image itself, the pixel array which produces that display image, or the contents of a frame buffer memory which drives the pixel array. FIG. 3A shows a display image showing the inventor's initials "SH" and a triangle. This may be a static image which has been displayed for any period of time. Then, the pixel engine causes the image to shift one or more pixels to the right, such as if the image were to begin scrolling to the right. If the SLM is not properly controlled, tearing may occur, as shown in FIG. 3B. The new pixel values for the upper portion of the image have been updated (causing that portion of the image to shift to the right), but the new pixel values for the lower portion of the image have not been updated before the image has been committed or refreshed to the display. FIG. 3C represents the desired outcome, in which the entire image has been shifted to the right and all pixels have received new values before the image is committed to the display. Ideally, the display pixel values will be completely updated to the pixel array before the pixel array is committed to the display, so the user does not see tearing. In some embodiments, this may mean that the pixel values should be completely updated to a back buffer before the back buffer is committed to the front buffer, or that the pixel values should be completely updated to a first ping-pong buffer before ping-ponging the display to the first buffer from a second buffer that held the prior frame.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIG. 1 shows a conventional SLM display system according to the prior art.

FIG. 2 shows an exemplary PWM transfer curve of an SLM pixel array cell.

FIGS. 3A–C show tearing in a raster display.

DETAILED DESCRIPTION

While the invention will be described with reference to an exemplary embodiment of an SLM display system, the invention is not necessarily limited to the embodiment shown, nor even to SLM systems. The invention may find applicability in a wide variety of display or other applications.

Figure 4:
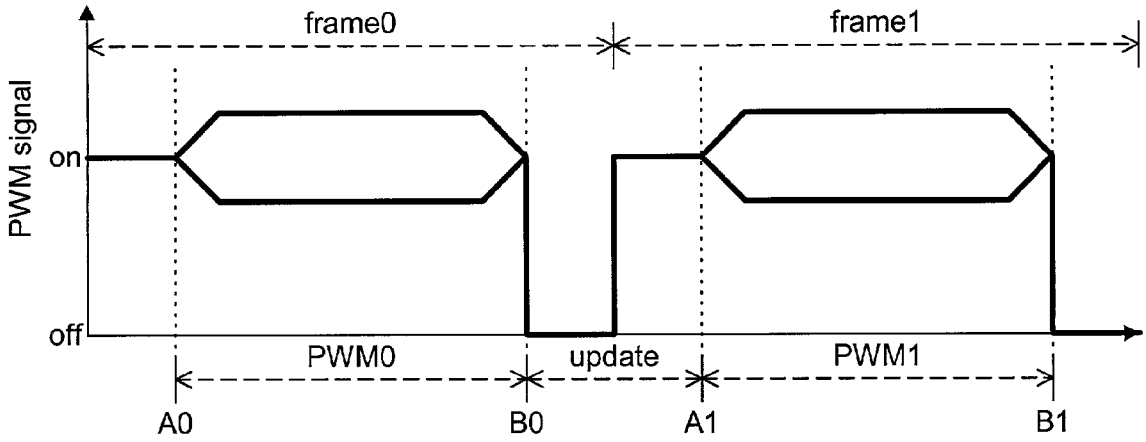
FIG. 4 shows two consecutive frames of operation of the invention.

FIG. 4 illustrates two consecutive frames ("frame 0" and "frame 1") of display time. Each includes an initial "on" period during which the PWM signal should be held on, a "PWM" period during which the pixel's appearance is determined by the PWM signal, and an "off" period during which the PWM signal is held off. Most suitably, the "A" point, the end of the time in which the PWM signal is forced to be "on", will coincide generally with the earliest time at which the PWM signal begins to cause a perceived change in the brightness of the pixel, while the "B" point, the latest point at which the PWM signal is allowed to be on, will coincide generally with the earliest time at which the PWM signal stops causing perceived change in the brightness of the pixel.

In the first frame, the PWM period is from a first time "A0" at the start of the PWM period to a second time "B0" at the end of the PWM period. In the second frame, the PWM period is from a first time "A1" at the start of the PWM period to a second time "B1" at the end of the PWM period.

This invention makes use of the period from "$B_0$" to "$A_1$" to update the frame buffer memory contents. This invention makes use of the fact that the PWM signal has a deterministic waveform from "B" to "A", which is not dependent upon the pixel data value.

Figure 5:
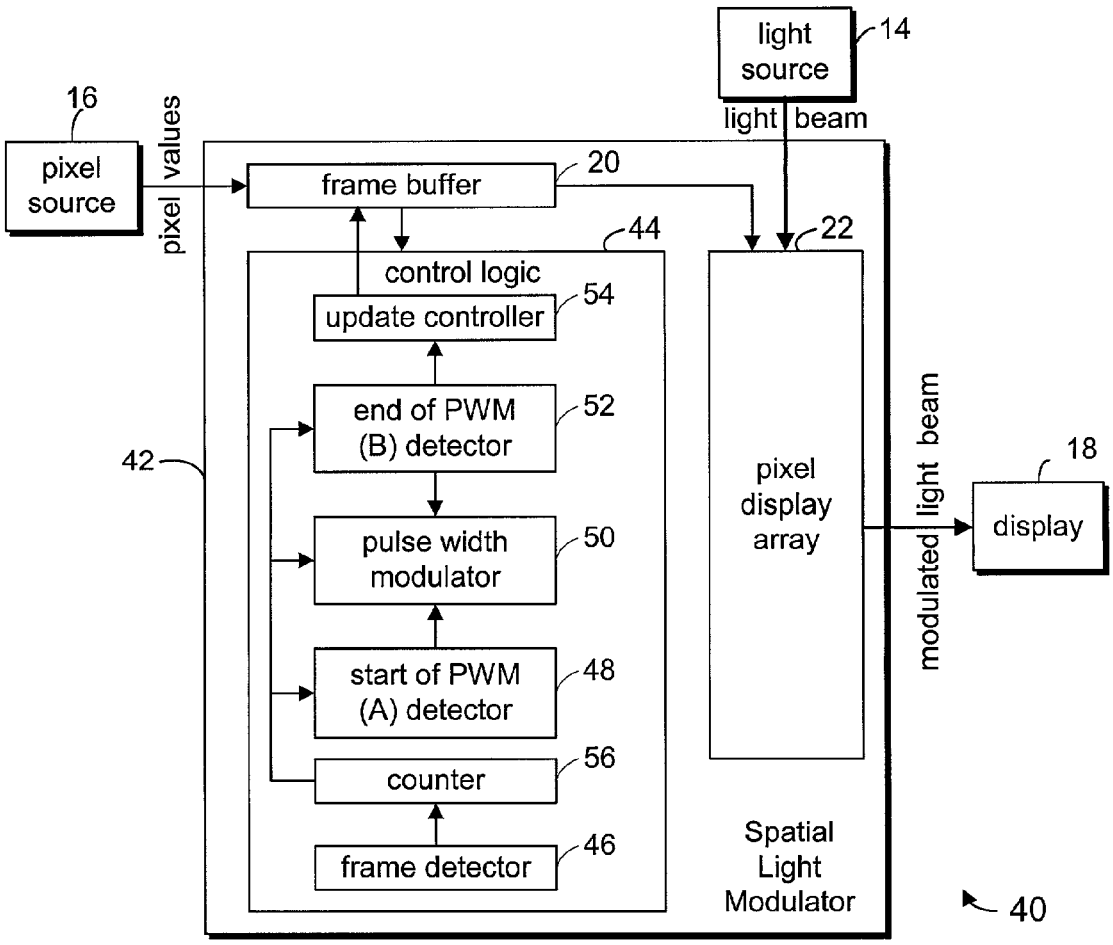
FIG. 5 shows a display system according to the invention.

FIG. 5 illustrates an SLM display system 40 according to one embodiment of this invention. The SLM 42 receives pixel values from a pixel source 16, modulates light from a light source 14, and provides the modulated light to a display 18. The SLM includes a pixel display array 22, which is controlled by control logic 44 and whose values come from a frame buffer 20. The control logic includes a frame detector 46 which detects the boundary between consecutive frames. The control logic also includes logic 48 for detecting the start of a PWM period, a pulse width modulator 50, and logic 52 for detecting the end of the PWM period. The control logic further includes an update controller 54 which governs the transfer of pixel values from the pixel source into the frame buffer. In some embodiments, various of these logic systems may be simple comparators which compare respective predetermined values against a counter 56 value which increments from 0 to N during each frame and which is reset by the frame detector at the start of each new frame. Other embodiments are, of course, within the ability of the skilled reader of this disclosure. The pulse width modulator may, in some embodiments, include a lookup table (not shown) for implementing a non-linear transfer curve function for the PWM signal.

Figure 6:
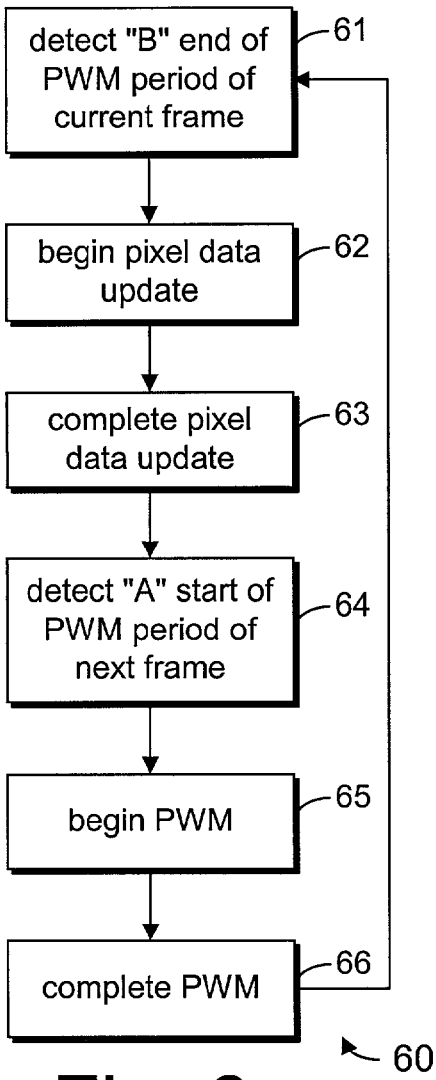
FIG. 6 shows a method of operation of the invention.

FIG. 6 illustrates one embodiment 60 of a method of operation of the SLM display system, which will be explained with reference also to FIGS. 4 and 5. After the end-of-PWM detector 52 detects (61) the end of the current frame's PWM period ("B0" in FIG. 4), the update controller 54 enables the frame buffer to begin (62) updating its pixel value contents from the pixel source 16. The frame buffer completes (63) updating the pixel value contents before the start-of-PWM detector 48 detects (64) the start of the next frame's PWM period ("A1" in FIG. 4). At the start of the next frame's PWM period, the pulse width modulator 50 begins (65) performing the PWM signal's transfer curve function, and the pixel cell is illuminated accordingly. The PWM signal function completes (66) at or before the end of the PWM period (61).

Figure 7:
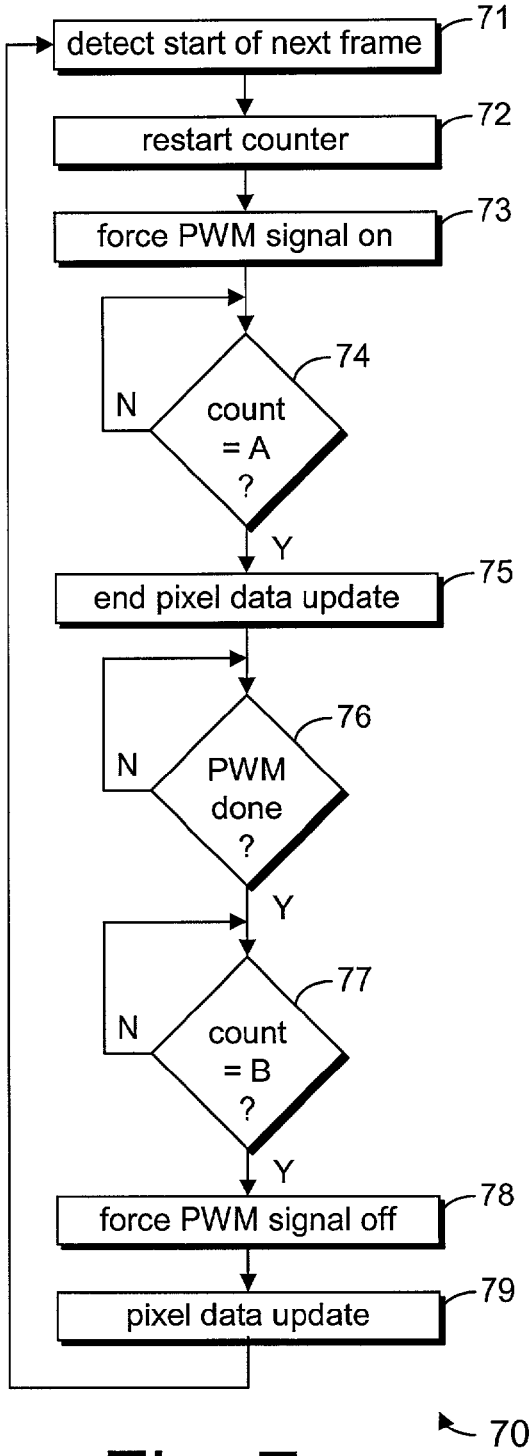
FIG. 7 shows another method of operation of the invention.

FIG. 7 illustrates another embodiment 70 of a method of operation of the SLM display system, and will be explained with reference also to FIGS. 4 and 5. The frame detector 46 detects (71) the start of a new frame period, and the counter 56 is reset (72). The pulse width modulator 50 forces (73) the PWM signal on. When the start-of-PWM detector 48 detects that the counter has reached (74) a value corresponding to the "A" start of the PWM period, the pixel data update will have ended (75), and the pulse width modulator 50 begins executing the non-deterministic portion of the PWM signal waveform. When the counter reaches (76) a value corresponding to the desired brightness of the pixel, the pulse width modulator turns the PWM signal off, and the final brightness of the pixel has been reached. When the end-of-PWM detector 52 detects that the counter has reached (77) a value corresponding to the "B" end of the PWM period, the PWM signal is forced (78) off (although it should already have been turned off at the end of its PWM period, per its brightness value), and the update controller 54 enables the frame buffer to read (79) in the new pixel data values from the pixel source, which will be completed before the counter reaches (74) the "A" value at the start of the next frame's PWM period, but not necessarily before the start of the next frame. The frame buffer can, in some embodiments, take advantage of the entire deterministic period from "B0" to "A1" in updating its pixel data value contents.

The reader will appreciate that these are but exemplary methods, and that other methods will be appreciated in light of this disclosure and are within its scope.

The reader should further appreciate that, although the invention has been described in terms of a spatial light modulator, the principles of this invention can readily be applied in other pulse width modulation applications, such as liquid crystal displays, flat panel plasma displays, and so forth.

The reader should appreciate that drawings showing methods, and the written descriptions thereof, should also be understood to illustrate machine-accessible media having recorded, encoded, or otherwise embodied therein instructions, functions, routines, control codes, firmware, software, or the like, which, when accessed, read, executed, loaded into, or otherwise utilized by a machine, will cause the machine to perform the illustrated methods. Such media may include, by way of illustration only and not limitation: magnetic, optical, magneto-optical, or other storage mechanisms, fixed or removable discs, drives, tapes, semiconductor memories, organic memories, CD-ROM, CD-R, CD-RW, DVD-ROM, DVD-R, DVD-RW, Zip, floppy, cassette, reel-to-reel, or the like. They may alternatively include down-the-wire, broadcast, or other delivery mechanisms such as Internet, local area network, wide area network, wireless, cellular, cable, laser, satellite, microwave, or other suitable carrier means, over which the instructions etc. may be delivered in the form of packets, serial data, parallel data, or other suitable format. The machine may include, by way of illustration only and not limitation: microprocessor, embedded controller, PLA, PAL, FPGA, ASIC, computer, smart card, networking equipment, or any other machine, apparatus, system, or the like which is adapted to perform functionality defined by such instructions or the like. Such drawings, written descriptions, and corresponding claims may variously be understood as representing the instructions etc. taken alone, the instructions etc. as organized in their particular packet/serial/parallel/etc. form, and/or the instructions etc. together with their storage or carrier media. The reader will further appreciate that such instructions etc. may be recorded or carried in compressed, encrypted, or otherwise encoded format without departing from the scope of this patent, even if the instructions etc. must be decrypted, decompressed, compiled, interpreted, or otherwise manipulated prior to their execution or other utilization by the machine.

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. A spatial light modulator, comprising:

a frame buffer to store pixel data values;

a pixel display array including a plurality of pixel cells to modulate input light according to the pixel data values in the frame buffer; and control logic including, a pulse width modulator for providing a PWM signal to the pixel display array, the PWM signal including, during a frame, a first period during which the PWM signal is forced on, a PWM period during which perceived brightness of a pixel cell is determined, and a second period during which the PWM signal is forced off, and an update controller for enabling the frame buffer to store the pixel data values during the second period of a current frame and the first period of a next frame.

2. The spatial light modulator of claim 1 wherein the pulse width modulator comprises:

a lookup table for implementing a non-linear transfer curve of the PWM signal.

3. The spatial light modulator of claim 2 wherein the lookup table has stored in it values representing the non-linear transfer curve.

4. The spatial light modulator of claim 1 wherein the control logic further includes:

a counter; and a frame detector adapted to reset the counter upon detecting a boundary between frames.

5. The spatial light modulator of claim 4 wherein the control logic further comprises:

a start-of-PWM detector coupled to the counter to detect an end of the first period;

an end-of-PWM detector coupled to the counter to detect a start of the second period;

wherein the update controller is responsive to the end-of-PWM detector detecting the start of the second period, to enable the frame buffer to store the pixel data values.

6. The spatial light modulator of claim 5 wherein the start-of-PWM detector and the end-of-PWM detector comprise:

a comparator for comparing a value from the counter to respective predetermined values.

7. An apparatus comprising:

means for performing pulse width modulation of a display pixel during a PWM period of a current frame according to pixel data values from a frame buffer; and means for updating pixel data values in the frame buffer during a period between an end of the PWM period of the current frame and a start of a PWM period of a next frame and including at least a portion of the next frame.

8. The apparatus of claim 7 further comprising:

the frame buffer.

9. The apparatus of claim 7 further comprising:

the display pixel.

10. The apparatus of claim 9 further comprising:

a pixel display array including the display pixel and a plurality of other display pixels.

11. The apparatus of claim 10 further comprising:

the frame buffer.

12. The apparatus of claim 7 wherein the means for updating comprises:

a counter.

13. The apparatus of claim 12 wherein the means for updating further comprises:

means for resetting the counter at a start of each frame.

14. The apparatus of claim 13 wherein the means for performing pulse width modulation comprises:

means for implementing a non-linear transfer curve during the PWM period.

15. The apparatus of claim 14 wherein the means for performing pulse width modulation further comprises:

means for forcing on modulation of the pixel at the start of each frame.

16. The apparatus of claim 15 wherein the means for implementing the non-linear transfer curve comprises:

a lookup table to store data values representing the non-linear transfer curve.

17. The apparatus of claim 16 wherein the lookup table has the data values stored therein.

18. A method of performing pulse width modulation of a display pixel cell by driving the display pixel cell according to a PWM signal, the method comprising:

for each pixel cell of a plurality of pixel cells in a pixel cell array, during a first period at a start of a frame, forcing the PWM signal on, during a PWM period after the first period, executing a PWM transfer curve to determine a brightness of the display pixel cell as indicated by a respective pixel data value in a frame buffer corresponding to the pixel cell, and during a second period after the PWM period, forcing the PWM signal off; and during the second period of a current frame and at least a portion of the first period of a next frame, updating pixel data values in the frame buffer.

19. The method of claim 18 wherein the updating pixel data values takes substantially from the end of the current frame's PWM period to the start of the next frame's PWM period.

20. The method of claim 18 wherein executing the PWM transfer curve comprises:

executing a non-linear transfer curve.

21. The method of claim 20 wherein the non-linear transfer curve effects substantially equal increments in perceived brightness for each incremental pixel data value.

22. The method of claim 18 further comprising:

modulating light by a spatial light modulator.

23. The method of claim 18 further comprising:

comparing a value from a counter against a first predetermined value to detect the start of the second period.

24. The method of claim 23 further comprising:

comparing a value from the counter against a second predetermined value to detect the end of the first period.

25. An article of manufacture comprising:

a machine-accessible medium including data that, when accessed by a machine, cause the machine to perform to method of claim 18.

26. The article of manufacture of claim 25 wherein the machine-accessible medium further includes data that cause the machine to perform:

comparing a value from counter against a first predetermined value to detect the start of the second period; and comparing a value from the counter against a second predetermined value to detect the end of the first period.

27. A method of operating a spatial light modulator which includes a pixel display array, the method comprising:

during a first period, pulse width modulating a PWM signal to set brightnesses of pixels in the pixel display array according to respective pixel data values in a frame buffer; and during a second period substantially not overlapping the first period and including portions of a current frame period and a next frame period, updating the pixel data values.

28. The method of claim 27 further comprising:

during the second period, applying a deterministic waveform to the PWM signal.

29. The method of claim 26 wherein applying the deterministic waveform comprises:

during the current frame period of the second period, forcing the PWM signal off; and during the next frame period of the second period, forcing the PWM signal on.

* * * * *